United States Patent [19]

Bollinger et al.

[11] Patent Number: 4,971,157

[45] Date of Patent: Nov. 20, 1990

[54] APPARATUS FOR THE REMOVAL OF SPOIL WHEN MAKING TRENCHES OF GREAT DEPTH

[75] Inventors: Karl Bollinger, Rueil Malmaison; Philippe Chagnot, Moret sur Loing; Joseph Dietsch, Bergheim, all of France

[73] Assignee: Societe Anonyme dite - SOLETANCHE, Nanterre, France

[21] Appl. No.: 384,976

[22] Filed: Jul. 25, 1989

[30] Foreign Application Priority Data

Jul. 26, 1988 [FR] France ..... 83 10067

[51] Int. Cl.[5] ..... E21B 7/02; E21B 19/02; E02F 3/24; E02F 9/14

[52] U.S. Cl. ..... 175/103; 37/189; 175/203; 175/104; 175/321

[58] Field of Search ..... 175/321, 102, 103, 104, 175/94, 207, 216, 161, 162, 203

[56] References Cited

U.S. PATENT DOCUMENTS

| | | | |
|---|---|---|---|
| 2,007,666 | 7/1935 | Smith | 175/321 X |
| 2,548,616 | 4/1951 | Priestman et al. . | |
| 2,800,301 | 7/1957 | Selberg et al. | 175/103 X |
| 3,255,612 | 6/1966 | Mayer et al. | 175/321 X |
| 3,285,629 | 11/1966 | Cullen et al. | 285/119 |
| 3,313,346 | 4/1967 | Cross . | |
| 3,599,735 | 8/1971 | Slator et al. | 175/293 |
| 3,753,468 | 8/1973 | Casagrande | 175/321 X |
| 3,848,685 | 11/1974 | Takagi et al. | 175/103 X |
| 4,196,781 | 4/1980 | Cheek | 175/321 X |

OTHER PUBLICATIONS

Article, "Depth Record Set by Rig Using Flexible Drillstream" *World World Oil*, Nov. 1971, pp. 75–77.

*Primary Examiner*—Stephen J. Novosad
*Attorney, Agent, or Firm*—Schweitzer & Cornman

[57] ABSTRACT

Apparatus including a rotary drilling cutter and a spoil removal conduit for the digging of a deep trench, characterized in that the spoil removal conduit is gradually adjustable in length during excavation and comprises: (a) a first conduit section, arranged proximate to said rotary cutter, and comprised of associated slidingly adjustable rigid male and female telescopic tube elements; (b) a second conduit section comprising a flexible tube having two ends, said flexible tube being connected to said first conduit section by one of its ends, its other end being disposed in the vicinity of the ground at a predetermined spoil discharge point, (c) a pulley supporting said flexible tube between said two ends; (d) lifting gear for suspending said pulley; and (e) a first cable associated with said lifting gear for supporting said pulley at selected adjustable heights.

4 Claims, 4 Drawing Sheets

Figure 1:
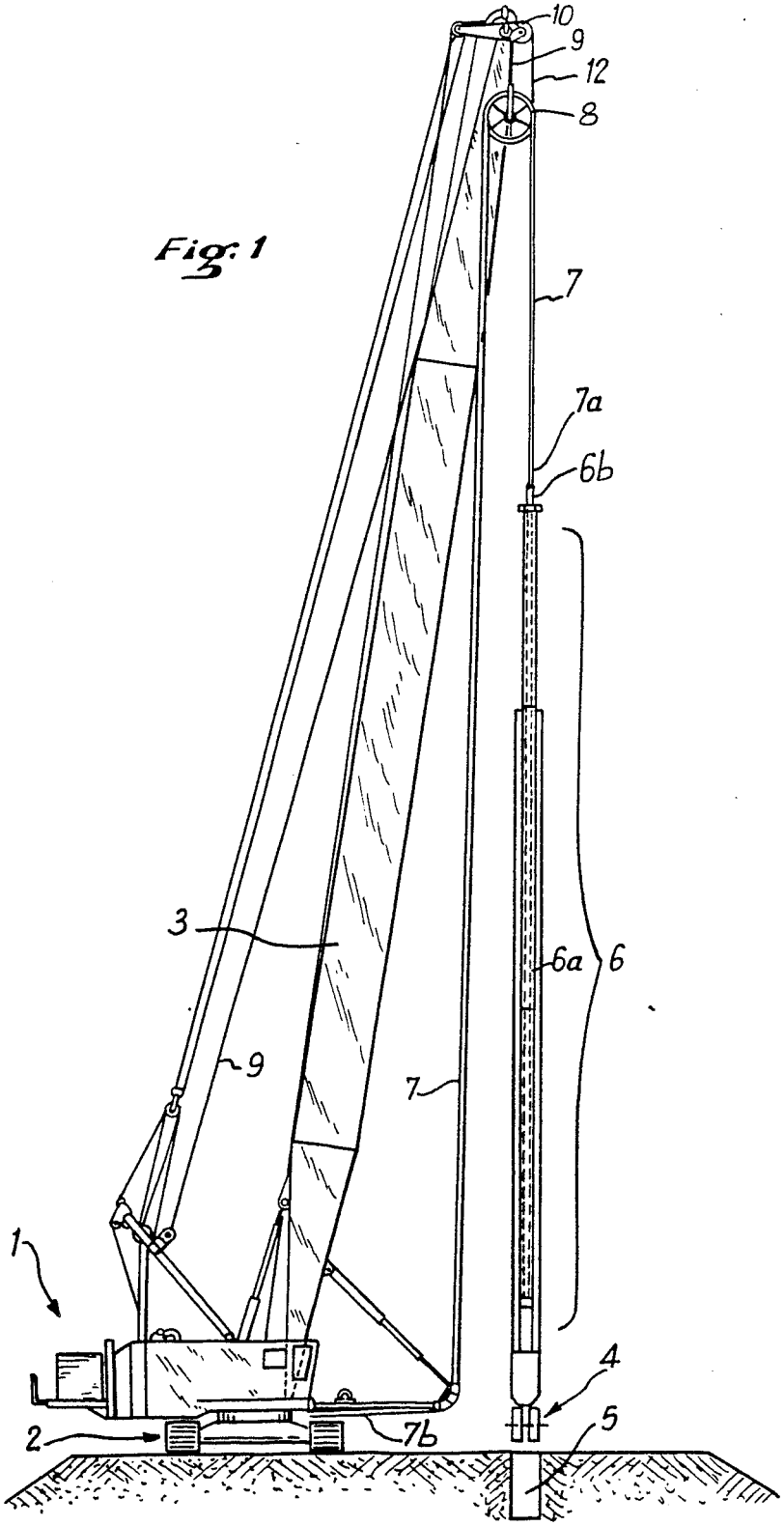

10
9
12
8
7
7a
6b
3
6a
6
9
7
1
4
5
2
7b

APPARATUS FOR THE REMOVAL OF SPOIL WHEN MAKING TRENCHES OF GREAT DEPTH

The present invention relates to an apparatus for the removal of excavated material or spoil produced when making trenches or excavations of great depth.

It is already known to cut trenches or excavations by means of milling or rotary cutters which are driven rotationally by hydraulic or electrical means for breaking up the soil as they operate at the bottom of the trench being drilled, the trench being filled with mud so as to ensure that its walls are supported.

It is also known to remove the spoil by a conduit which brings it up to the top of the trench, conveying spoil with the use of a pump whilst such spoil is mixed with the mud lining the trench.

At the present day trenches or excavations of this kind are dug with depths of up to 100 to 200 meters, which presents considerable difficulties as regards the conduit through which the mixture of spoil and mud is removed.

As it is not possible to use lifting gear of too great a height, one solution is to interrupt the drilling in order to lengthen the spoil-removing conduit by the addition of a new section. This solution has the disadvantage of making it necessary to interrupt work, resulting in a considerable loss of time and financial disadvantage since the very expensive equipment required for this kind of work has to be left idle.

The present invention relates to an apparatus wherewith it is possible to dig trenches or excavations of great depth with the use of a lifting gear the height of which amounts to only a fraction of the depth of the trench, and without any need to interrupt the drilling work to modify the structure of the apparatus used for removing the spoil.

The present invention provides an apparatus for the removal of spoil producing in the digging of a trench or excavation under mud to a considerable depth, characterised in that the spoil removal conduit comprises a first lower section arranged in the vicinity of the drilling rotary cutters, this being constituted by a telescopic tube, and a second section constituted by a flexible tube which is connected to the first section at one of its ends and whose other end terminates in the vicinity of the ground at the point where the spoil is discharged, this second section being supported between its two ends by a pulley which is suspended on the upper portion of the lifting gear and the height of which can be varied in the course of working.

According to a preferred form of embodiment of the invention it is advantageous to provide a locking device whereby the two elements of the telescopic tube can be made fast with one another, especially in the position wherein these two elements are withdrawn into one another.

According to a preferred form of embodiment of the invention the second flexible section of conduit is supported by a pulley itself suspended on a cable extending down from the top of the lifting gear, the cable being wound on a winch exerting preferably a constant force.

In this way the flexible section of the conduit adapts itself automatically to the configuration of the apparatus which varies with the descent of the rotary cutters into the soil.

According to a preferred form of embodiment the upper portion of the female element of the telescopic tube and also the upper portion of the male element of this tube are held in a vertical position by means of guide eyes with which they are integral and through which extends a cable supporting the rotary cutter machine whilst the latter is working.

The apparatus according to the invention makes it possible for example when using a lifting gear having a total height of about 50 meters to dig excavations the depth of which may reach about 140 meters, without there being any need to modify the structure of the apparatus when the rotary cutter machine descends down the trench.

The apparatus according to the invention may be operated in various ways.

In all cases, at the instant of starting drilling, the two elements of the telescopic tube are retracted one within the other and are locked to one another in such a manner that the telescopic tube is not extended under the action of the pressure displacing the spoil, whilst the pulley supporting the flexible section is moved up to the top of the lifting gear.

According to a first mode of employment the pulley is then lowered progressively as drilling proceeds so that the telescopic tube, the two elements of which are retracted one within the other, penetrates into the soil as the rotary cutter machine descends, up to the instant at which the top portion of the telescopic tube arrives at ground level.

After unlocking of the two telescopic elements and fixing the top of the male element to the ground surface, the rotary cutter machine can continue to descend, whereas the two elements of the telescopic tube move away gradually from one another up to their maximum extent.

It is then sufficient to release the male element from its fixing to the ground surface and bring about the progressive downward movement of the pulley which supports the flexible section of the conduit as far as the vicinity of the ground so that the maximum excavation depth can be achieved.

According to another mode of employment, starting from the initial position it is possible to begin drilling by lowering the pulley and leaving the two elements of the telescopic tube nested in one another, then, when the greatest depth attainable in this configuration has been reached, the rotary cutter machine is simply moved upwards to unlock the two elements of the telescopic tube and bring them into the opened-out position, which makes it possible to dig the trench to its maximum depth.

To enable the invention to be better understood, a description will now be given, without implying any limitative character, of a form of embodiment which is taken as an example and illustrated in the drawings.

Figure 4:
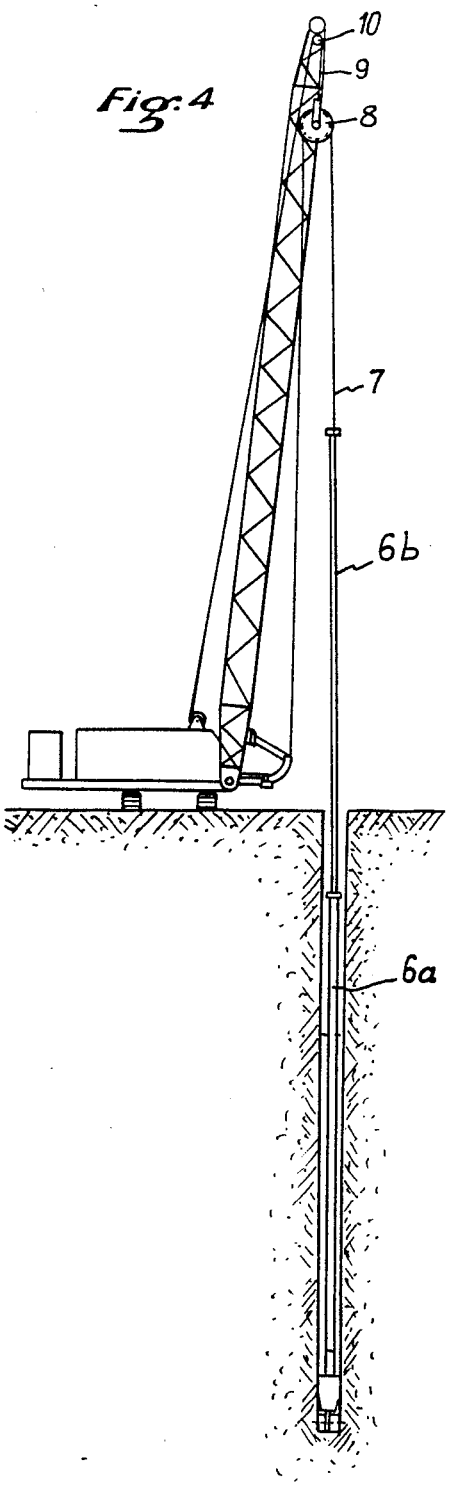
Figure 5:
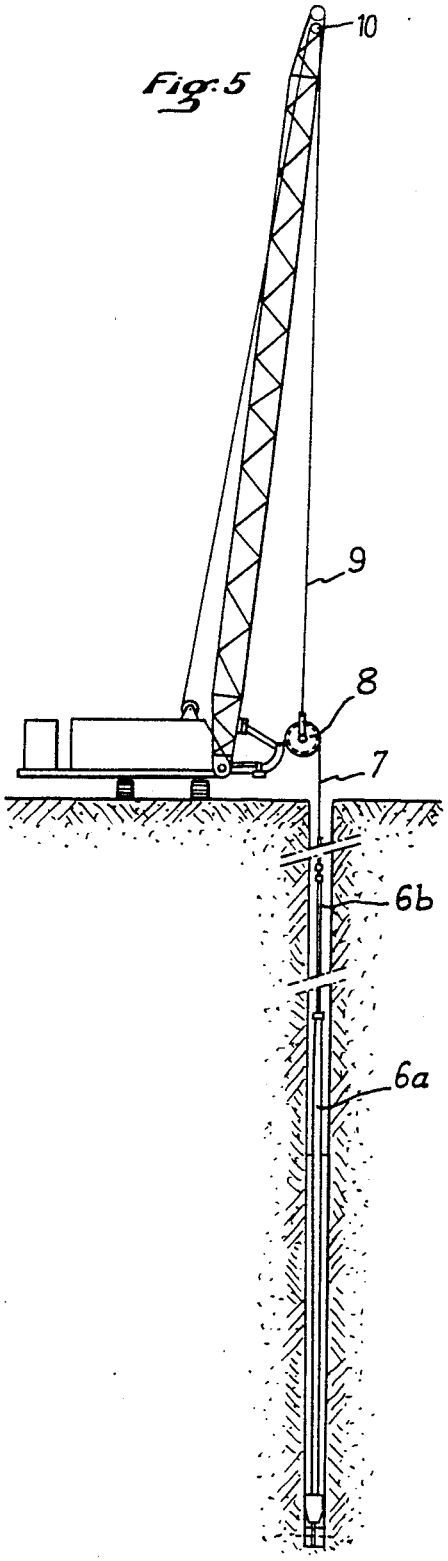
Figure 6:
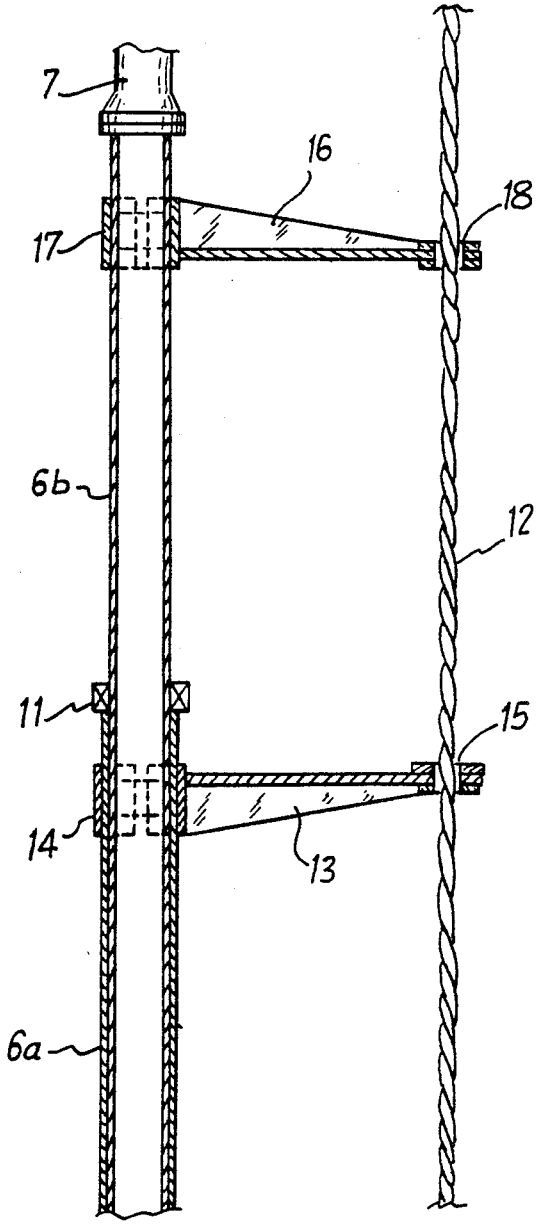

In these drawings:

FIG. 1 is a diagrammatic view in elevation of an apparatus according to the invention, FIGS. 2 to 5 represent diagrammatic views on a smaller scale of the apparatus according to FIG. 1 in configurations corresponding to the various phases of its operation, and FIG. 6 is a diagrammatic view of a device for holding the upper portion of the telescopic tube.

FIG. 1 shows a crane 1 mounted on crawler tracks 2, the crane jib 3 being of conventional type and extending upwards to a considerable height which may be for example several dozen meters.

The rotary cutter machine 4 is also shown, in a diagrammatic manner, this being intended to dig the trench 5 in the soil whilst it is suspended from the top of the crane by one or more cables which are not shown here.

The rotary cutters are driven in rotational movement by means of electrical or hydraulic motors which are supplied from the crane or a power unit via leads not shown.

According to the invention the removal of the drilling spoil mixed with the mud from the trench is effected by a conduit comprising a first telescopic section 6 constituted by a female element 6a within which there can slide a male element 6b which itself constitutes a tube through which spoil and mud can travel.

According to a preferred form of embodiment of the invention a locking device can be used for immobilising the element 6b relatively to the element 6a, especially in the position wherein these two elements are completely retracted within one another, as may be seen from FIG. 1.

FIG. 1 also shows the second section 7 of flexible conduit one end 7a of which is connected to the end of the element 6b and whose other end 7b terminates in the vicinity of the ground at the conduit for discharging spoil at a suitable place, with possible separation and recovery of the mud.

According to the invention the section of flexible conduit 7 is supported by a pulley 8 itself suspended on a cable 9 passing over a pulley 10 at the top of the jib 3 of the crane, so that it is possible from ground level to move the pulley as and when desired to make it move upwards or downwards relatively to the top of the crane.

According to a preferred form of embodiment of the invention, the other end of the cable 9 is connected to a winch which subjects it to a constant force, thus allowing the position of the pulley 8 to be adapted automatically to the downward progress of the rotary cutter machine.

The apparatus according to the invention is shown in FIG. 1 in its highest position, the male element 6b being telescoped to the maximum extent within the female element 6a of the telescopic section 6, and the pulley 8 being moved up into its highest position relatively to the top of the crane.

In this configuration the rotary cutters are situated slightly above the ground.

It will be appreciated that, because of the invention, it is possible, starting from this position, to carry out continuous removal of spoil as the rotary cutter machine descends, by downward movement of the pulley or by displacement of the element 6b relatively to the element 6a by extending the section of telescopic tube 6, or by combined use of these two movements.

It will also be appreciated that the amount of the downward movement of the rotary cutter machine 4 corresponds substantially to two times the height of the lifting gear plus the increase in length of the telescopic section 6 which corresponds to the maximum projection of the element 6b out of the element 6a.

Thus with a crane the top of whose jib is situated about 30 meters from the ground, and with a telescopic section which in the telescoped state has a length of about 30 m, it is possible to produce excavations to a depth of more than 90 m.

The various phases of one use of the apparatus according to the invention are illustrated in FIGS. 2 to 5.

Figure 2:
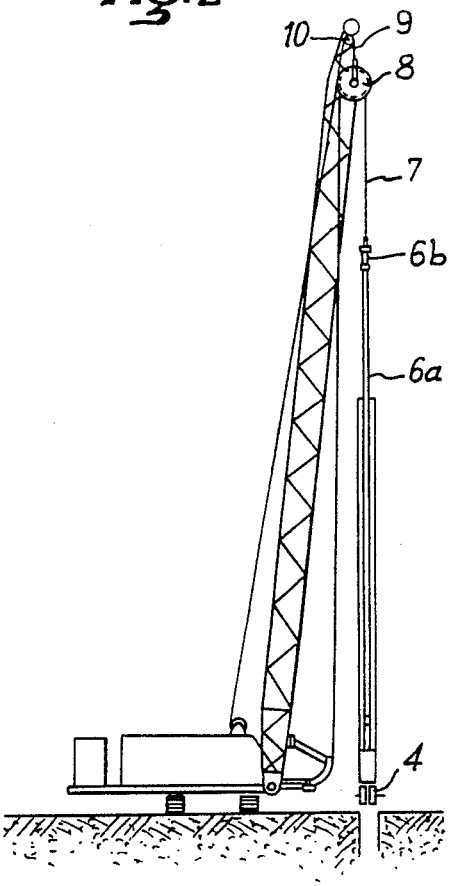

FIG. 2 shows the apparatus in its initial position wherein the male element 6b of the telescopic tube is completely retracted within the female element 6a, the pulley 8 being taken to the top of the lifting gear.

In this position the rotary cutters are situated substantially at ground level, and the elements 6a and 6b are fastened to one another by any suitable device situated at the upper portion of the telescopic tube.

In the form of embodiment described, the cable 9 which supports the pulley 8 is connected to a winch providing a constant torque such that the pulley 8 is subjected to a sufficient upward force to hold the flexible section 7 of the conduit whilst being able to follow the downward movement of the rotary cutters which move progressively further into the ground as they dig the trench.

Figure 3:
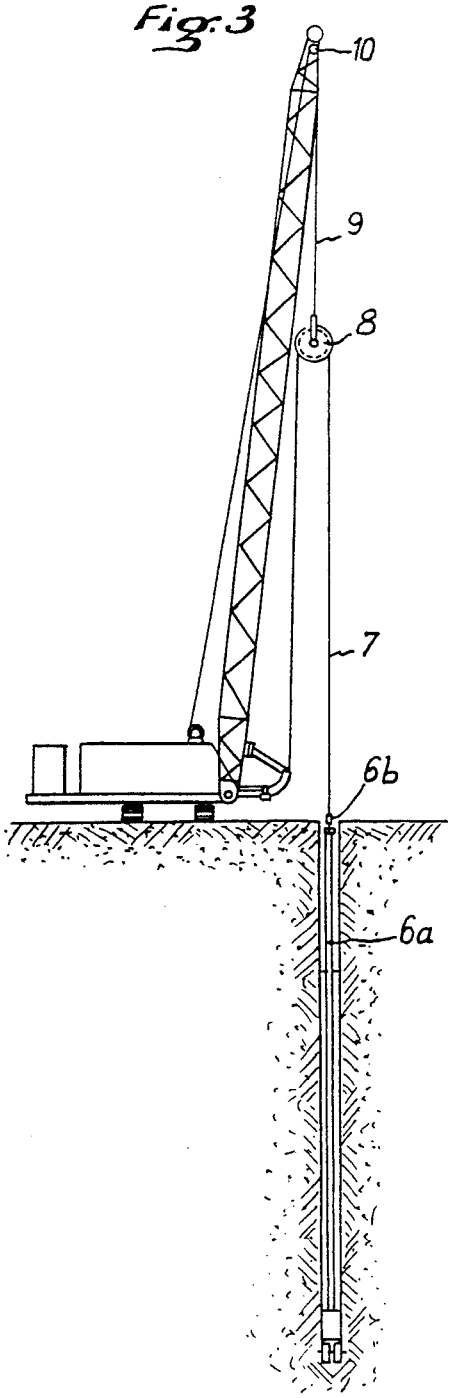

In this way the phase shown in FIG. 3 is reached, wherein the upper portion of the telescopic tube is situated in the vicinity of the surface of the ground.

The elements 6a and 6b of the telescopic tube are then released from one another, and under the action of the cable 9 the pulley 8 is taken upwardly until the male element 6b of the telescopic tube is fully moved out of the female element 6a. As digging is continued with the use of the rotary cutters, the assembly moves progressively into the ground as shown in FIG. 4.

First the male element 6b enters the trench fully, then is followed by the lower end of the section of flexible tube 7.

The phase shown in FIG. 5 is thus arrived at, which corresponds to the maximum depth for the rotary cutter machine.

In this Figure, for reasons of drawing legibility, the male element 6b of the telescopic tube has been shown in truncated, i.e. shortened, manner. The same has been done with the lower portion of the flexible tube 7.

It will be appreciated in fact that in the maximum depth position corresponding to FIG. 5 the elements 6a and 6b of the telescopic tube have remained in the position of FIG. 4, whilst the lowering of the pulley 8 has made it possible for the greater part of the length of the flexible tube 7 to enter the top of the trench.

It will be apparent that the description which has just been given of the apparatus according to the invention has no limitative effect as regards the use made of the said apparatus.

More especially it will be clear that it is possible, without thereby departing from the framework of the invention, to begin to move the rotary cutter machine downwardly to the maximum whilst holding the telescopic tube in the telescoped state and moving the pulley 8 down to the position shown in FIG. 5. Following which, after the apparatus has been taken up again, the elements of the telescopic tube are put in the opened-out state, which makes it possible to deepen the trench to a distance corresponding to the height of the telescopic tube.

A guide device for holding the elements of the telescopic tube in a vertical position is shown in FIG. 6.

This device is useful in the first instance for guiding the male element 6b when it is lifted from the female element 6a, and also for holding the top of the female element 6a in cases where the telescopic tube projects substantially above the frame of the cutter, as is the case in the form of embodiment shown in FIG. 1.

FIG. 6 again shows the telescopic tube female element 6a wherein the male element 6b is slidable.

The sealing element provided between these two elements and the locking device has been shown diagramatically at 11.

As before, the upper portion of the male element 6b is connected to the end of the flexible conduit 7.

It will be understood that when the element 6b is brought into the extended position relatively to element 6a, the telescopic tube can extend upwards to a height of several dozen meters above the frame of the cutter.

Since moreover the flexible tube 7 is capable of being subjected to movements due to the pumping of excavated material, it will be appreciated that it is preferable to hold the top of the telescopic tube in alignment with its lower portion.

According to the invention this is achieved by fixing in the vicinity of the top end of the female element 6a an arm 13 which engages by means of a screw sleeve 14 on the outer surface of the female tube 6a and which comprises an eye 15 through which passes the cable 12 which supports the rotary cutter machine 4.

It is known in fact that this type of apparatus comprises rotary cutting machines of considerable weight and that support has to be provided by means of one or more cables which end at the top of the lifting gear and which by traction exerted on them make it possible to determine the bearing force on the ground exerted by the rotary cutter machine.

As a result, the said cable or cables providing support are perfectly vertical and aligned with the rotary cutter machine.

In this way such a cable constitutes a perfectly efficacious guide support.

As shown in FIG. 6, a second arm 16 is fixed by means of a screwthreaded sleeve 17 on the upper portion of the male element 6b, and is provided with an eye 18 through which the cable 12 extends.

In the case of a male element 6b of great length, it is also possible to arrange one or more other arms provided with eyes between the sealing element 11 and the arm 16 which has just been described.

Naturally, such arms must be released and pushed upwards when the male element 6b is retracted into the female element 6a.

It will be understood that the forms of embodiment which have been described hereinbefore have no limitative character and that any desirable modifications could be made thereto without thereby departing from the scope of the invention.

We claim:

1. Apparatus including a rotary drilling cutter and a spoil removal conduit for the digging of a deep trench, characterized in that the spoil removal conduit is gradually adjustable in length during excavation and comprises:

(a) a first conduit section, arranged proximate to said rotary cutter, and comprised of associated slidingly adjustable rigid male and female telescopic tube elements; and (b) a second conduit section comprising a flexible tube having two ends, said flexible tube being connected to said first conduit section by one of its ends; its other end being disposed in the vicinity of the ground at a predetermined spoil discharge point;

(c) a pulley supporting said flexible tube between said two ends;

(d) lifting gear for suspending said pulley; and (e) a first cable associated with said lifting gear for supporting said pulley at selected adjustable heights.

2. Apparatus according to claim 1, further characterized in that:

(a) said lifting gear is a winch;

(b) said cable is wound on said winch and exerts constant torque.

3. Apparatus according to claim 1, characterized in that:

(a) the upper portion of the female tube element and the upper portion of the male tube element are aligned;

(b) a second cable supports said rotary drilling cutter;

(c) first support arms having aligned cable guides at their distal ends are fixed to each of said male and female tube elements; and (d) said second cable passes through said guides and maintains said drilling cutter in vertical alignment with said first conduit during excavation.

4. Apparatus according to claim 1, characterized in that:

(a) a locking device secures said male and female telescopic tube elements in a retracted, telescoped relation.

* * * * *